US007168987B1

(12) United States Patent
Morohoshi et al.

(10) Patent No.: US 7,168,987 B1
(45) Date of Patent: Jan. 30, 2007

(54) RIGHT ANGLE TYPE CONNECTOR USED FOR BALANCED TRANSMISSION OF DATA SIGNALS

(75) Inventors: Haruna Morohoshi, Sunnyvale, CA (US); Takeshi Okuyama, Sunnyvale, CA (US); Mitsuru Kobayashi, Shinagawa (JP); Tadashi Kumamoto, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 11/178,394

(22) Filed: Jul. 12, 2005

(51) Int. Cl.
*H01R 13/648* (2006.01)

(52) U.S. Cl. ..... 439/608

(58) Field of Classification Search ..... 439/607, 439/608, 609, 610
See application file for complete search history.

(56) References Cited

U.S. PATENT DOCUMENTS 5,161,999 A * 11/1992 Broschard et al. ..... 439/567
6,709,286 B1 * 3/2004 Korsunsky et al. ..... 439/557
2005/0026502 A1 * 2/2005 Wan et al. ..... 439/607

FOREIGN PATENT DOCUMENTS

JP 10-261457 9/1998

* cited by examiner

*Primary Examiner*—Phuong Dinh
(74) *Attorney, Agent, or Firm*—Staas & Halsey LLP

(57) ABSTRACT

A right-angle type connector used for balanced transmission of data is disclosed. The connector includes a connector main body, the connector main body including an alignment of contact members including a first signal contact member, a second signal contact member, and a ground contact member; a housing including base seat parts provided on both sides of the housing, the base seat parts having the connector main body attached therebetween in a manner that the alignment of contact members is partly exposed at a rear side of the connector main body; and a rear shield cover member mounted on the housing for covering at least the exposed part of the alignment of contact members.

17 Claims, 15 Drawing Sheets

(A)

(B)

(A)

(B)

RIGHT ANGLE TYPE CONNECTOR USED FOR BALANCED TRANSMISSION OF DATA SIGNALS

BACKGROUND OF THE INVENTION

1. Field of the Invention

The present invention generally relates to a right angle type connector used for balanced transmission of data signals, and more particularly to a right angle type connector which is used for balanced transmission of data signals having its connection part protruding from a window of an electronic device and its rear part housed inside the electronic device mounted on an end of a printed board in a state of being mounted on an end of a printed board.

2. Description of the Related Art

As for types of data transmission, there is an unbalanced transmission type of transmitting data signals by using a single electric wire for each corresponding data signal. Another type of data transmission is a balanced transmission type (differential transmission) using a pair of electric wires for each corresponding data signal. In the balanced transmission type, a positive signal and a negative signal with a size equal to but with an orientation opposite to the positive signal are transmitted simultaneously. The balanced transmission type has an advantage of being more resistant to noise compared to the unbalanced transmission type.

Accordingly, the use of the balanced transmission type is increasing for data signal transmission among electronic devices such as computers, servers, switchboards, and routers. In such a case where the balanced transmission type is used, the electronic devices are each provided with a balanced transmission connector(s), and the electronic devices are connected to each other by connecting balanced transmission connectors of the ends of a balanced transmission cable to the corresponding balanced transmission connectors of the electronic devices.

In recent years and continuing, the speed of transmitting network data signals is increasing along with the increase of information processing speed. As the signal transmission speed increases, electromagnetic noise more easily emanates (leaks) from the location at which the connector is situated. In order to prevent such leakage, it is important to strengthen the protection against electromagnetic noise and take appropriate measures against EMI (Electro-Magnetic Interference).

FIG. 1 shows a conventional example of a connector 10 (See for example, Japanese Laid-Open Patent Application No. 10-261457). The connector 10 is a right angle type connector used for balanced transmission of data signals. The connector 10 includes a connector main body 13 having a contact member 12 assembled with an electric insulating block member 11. The connector main body 13 is reinforced by being housed in a housing 14.

The connector 10 is mounted on an end part of a printed board 20 in the manner shown in FIG. 2. In FIG. 2, the connector 10 is fixed to the printed board 20 by having leg parts 14*a* of the housing 14 inserted in the holes 21 of the printed board 20. This inserted portion is soldered, to thereby secure the fixed state. A connecting part 15 is provided on a front side of the connector 10 in a manner protruding from a window of a panel 31 of an electronic device 30. The connector 10 is connected to a cable 40 used for balanced transmission by engaging the connecting part 15 with a connector 41 provided on an end part of the cable 40.

When viewing a rear part of the connector 10 (i.e. the part of the connector 10 situated toward the inside of the electronic device 30), a portion 12*b* of the contact member 12 is in an exposed state. The exposed portion 12*b* of the contact member 12 causes electromagnetic noise 50 to be irradiated inside the electronic device 30. Accordingly, an electronic component(s) 51 situated inside the electronic device 30 is susceptible to adverse effects from the electromagnetic noise 50.

SUMMARY OF THE INVENTION

It is a general object of the present invention to provide a right angle type connector used for balanced transmission of data signals that substantially obviates one or more of the problems caused by the limitations and disadvantages of the related art.

Features and advantages of the present invention are set forth in the description which follows, and in part will become apparent from the description and the accompanying drawings, or may be learned by practice of the invention according to the teachings provided in the description. Objects as well as other features and advantages of the present invention will be realized and attained by a right angle type connector used for balanced transmission of data signals particularly pointed out in the specification in such full, clear, concise, and exact terms as to enable a person having ordinary skill in the art to practice the invention.

To achieve these and other advantages and in accordance with the purpose of the invention, as embodied and broadly described herein, the invention provides a right-angle type connector used for balanced transmission of data, the connector including: a connector main body, the connector main body including an alignment of contact members including a first signal contact member, a second signal contact member, and a ground contact member, a housing including base seat parts provided on both sides of the housing, the base seat parts having the connector main body attached therebetween in a manner that the alignment of contact members is partly exposed at a rear side of the connector main body, and a rear shield cover member mounted on the housing for covering at least the exposed part of the alignment of contact members.

In the right-angle type connector according to an embodiment of the present invention, the exposed part of the alignment of contact members may include an elongated part that extends in a vertical direction from each one of the first signal contact members, the second signal contact members, and the ground contact members and a mounting contact part that extends in a horizontal direction from the elongated part.

In the right-angle type connector according to an embodiment of the present invention, the rear shield cover member may include a top plate part provided on a top part of the rear shield cover and a rear plate part provided on a rear part of the rear shield cover, wherein the top plate part and the rear plate part are arranged to form an L-letter shape.

In the right-angle type connector according to an embodiment of the present invention, the rear shield cover member includes a top plate part provided on a top part of the rear shield cover, a rear plate part provided on a rear part of the rear shield cover, and side plate parts provided on side parts of the rear shield cover, wherein the top plate part, the rear plate part, and the side plate parts are arranged to form a box shape.

In the right-angle type connector according to an embodiment of the present invention, the shield cover member includes a plurality of flat spring members abutting the housing.

In the right-angle type connector according to an embodiment of the present invention, the plural spring members are aligned in plural rows, wherein the flat spring members in one row of the plural rows face in an opposite direction with respect to the flat spring members of another row.

In the right-angle type connector according to an embodiment of the present invention, the shield cover member includes hook parts that are flexibly engaged with the base seat parts on both sides of the housing.

Other objects and further features of the present invention will be apparent from the following detailed description when read in conjunction with the accompanying drawings.

DESCRIPTION OF THE PREFERRED EMBODIMENTS

In the following, embodiments of the present invention are described with reference to the accompanying drawings.

First Embodiment

Figure 1:
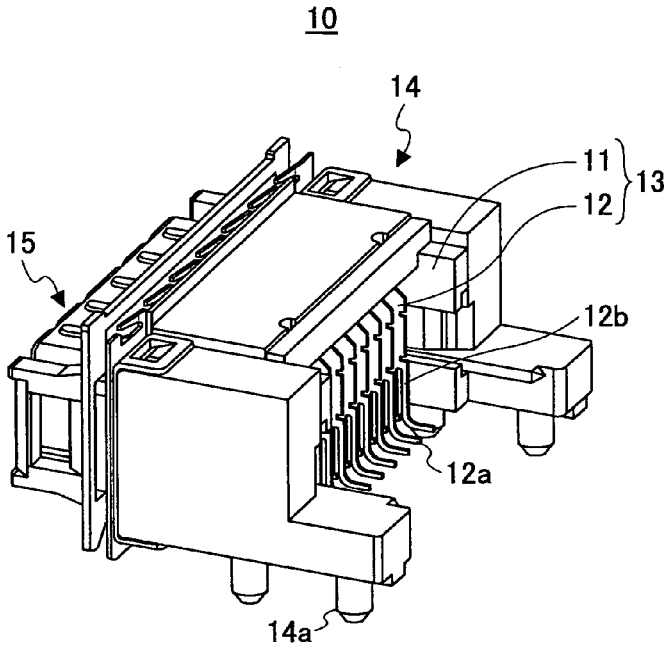
FIG. 1 is a perspective view showing a conventional example of a right angle type connector used for balanced transmission.
Figure 2:
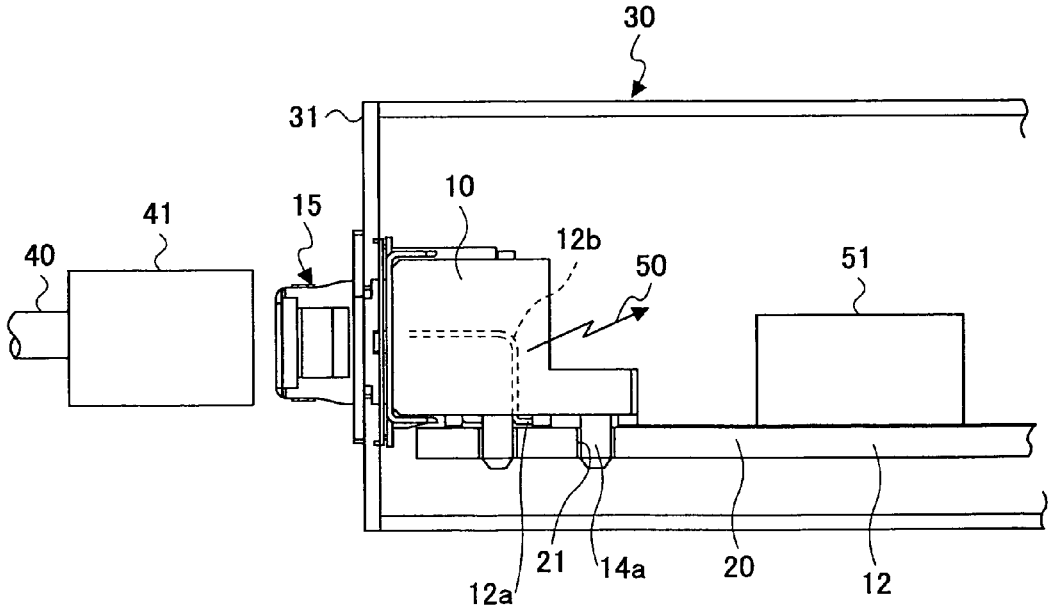
FIG. 2 is a drawing of the connector of FIG. 1 in a state of usage.
Figure 3:
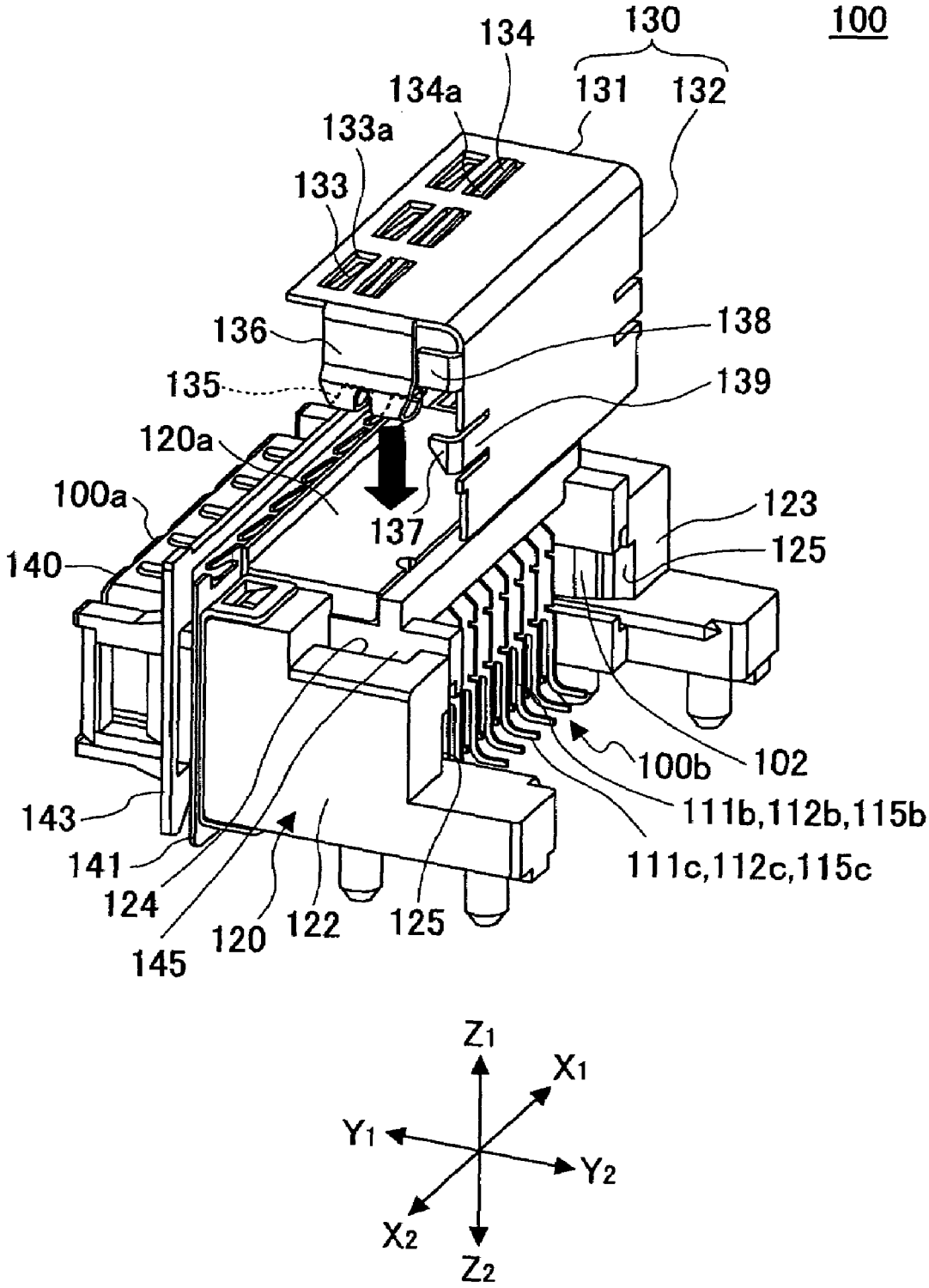
FIG. 3 is a perspective view showing a right angle type connector used for balanced transmission according to a first embodiment of the present invention.
Figure 4:
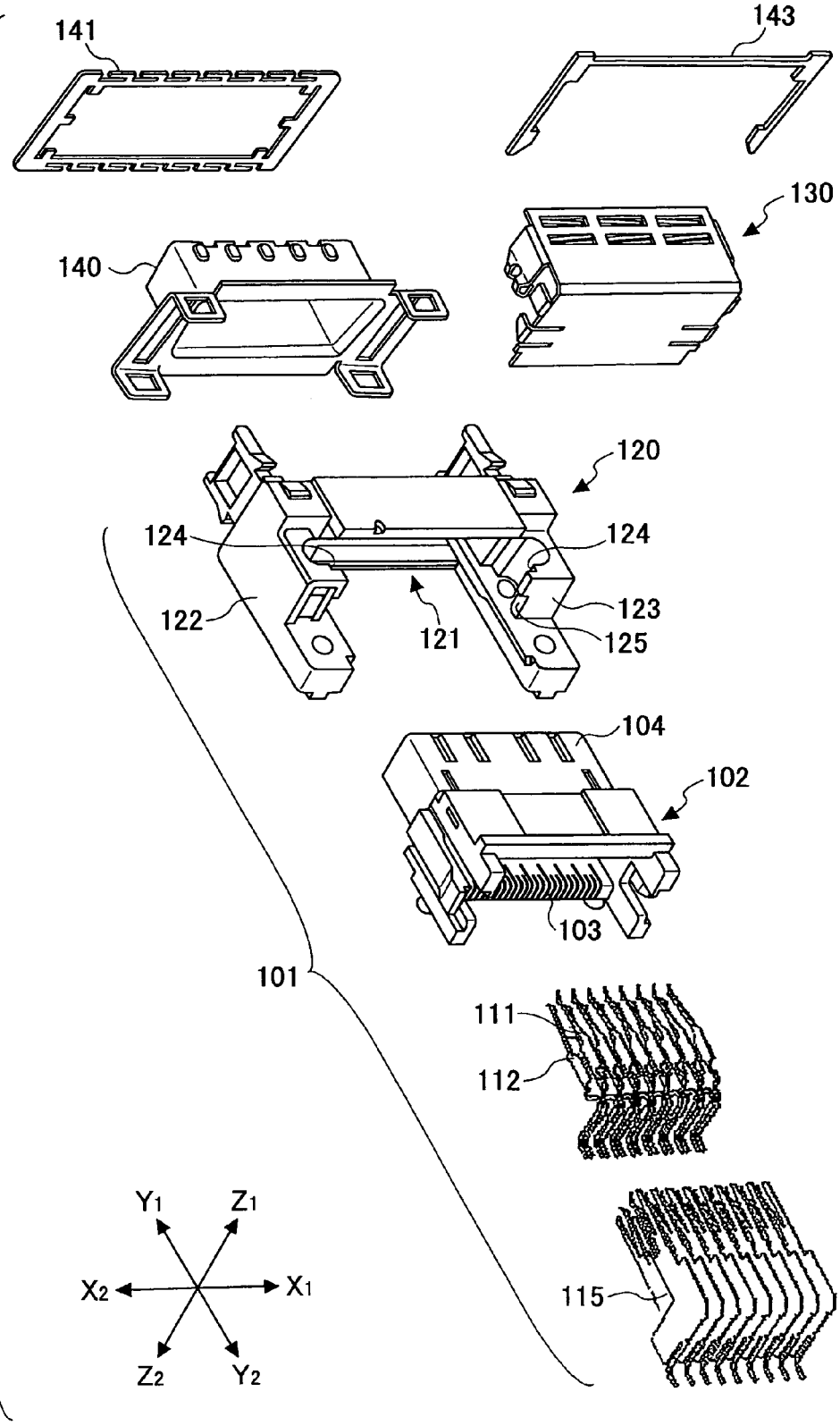
FIG. 4 is a perspective view of the connector shown in FIG. 3 in a disassembled state.
Figure 5:
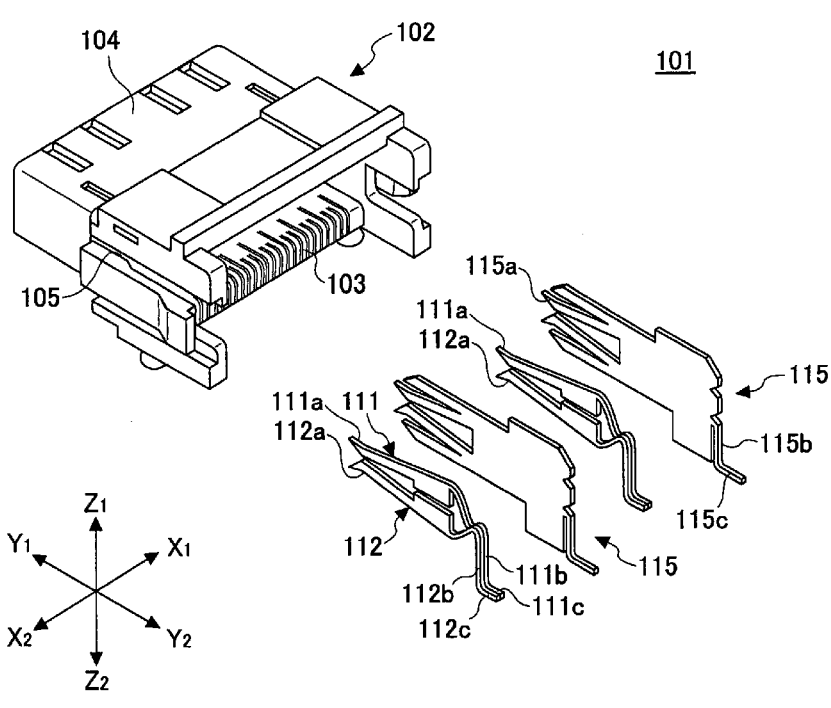
FIG. 5 is a perspective view showing a connector main body and an arrangement of contact members according to an embodiment of the present invention.

FIG. 3 shows a connector 100 according to the first embodiment of the present invention, in which the connector 100 is a right angle type connector used for transmitting data by balanced transmission (differential transmission). FIG. 4 is a perspective view of the connector 100 in a disassembled state. FIG. 5 is a schematic view showing a connector main body 101 of the connector 100 and an arrangement of contact members 111, 112, 115.

[Configuration of Connector 100]

The connector 100 includes a connector main body 101, a housing 120, and a rear shield cover member 130. It is to be noted that the rear shield cover member 130 is attached after the connector 100 is mounted on a printed board.

In the connector main body 101, a first signal contact member 111, a second signal contact member 112, and a ground contact member 115 are pressingly inserted in a block member 102 from direction Y2 to direction Y1 as shown in FIG. 5. The ground contact member 115 has a planar shape. The block member 102 has an electric insulating property and includes a rear part 103 situated toward direction Y2 and a front part 104 situated toward direction Y1. Furthermore, an engagement step part 105 is provided on a side(s) of the block member 102 for enabling insertion and engagement with respect to a U-shaped lug part 135 (described below).

The first signal contact member 111, the second signal contact member 112, and the ground contact member 115 are each formed with substantially an L-letter shape.

Inside the block member 102, a first signal contact part 111*a* of the first signal contact member 111 and a second signal contact part 112*a* of the second signal contact member 112 are aligned to form a pair in a vertical direction (Z1-Z2 direction, line direction). Furthermore, inside the block member 102, a ground contact part 115*a* of the ground contact member 115 and the pair of the first signal contact part 111*a* and the second signal contact part 112*a* are aligned in a predetermined interval in a horizontal direction (X1-X2 direction, row direction). In the example shown in FIG. 5, the ground contact part 115*a* has a shape similar to a fork. In the rear part 103 of the block member 102A, a narrow-shaped elongated part 112*b* and a mounting contact part 112*c* of the second signal contact member 112, a narrow-shaped elongated part 111*b* and a mounting contact part 111*c* of the first signal contact member 111, and a narrow-shaped elongated part 115*b* and a mounting contact part 115*c* of the ground contact member 115 are aligned at predetermined intervals in the X1-X2 direction along the rear part 103 in an exposed manner.

The housing 120 of the connector 100 is a component fabricated by die-casting. The housing 120 is made of a material such as magnesium. The housing 120 serves to reinforce the connector main body 101 in a manner encasing the connector main body 101. The housing 120 also serves to shield the connector especially towards the X1-X2 direction. As shown in FIG. 4, the housing 120 includes a square-shaped frame part 121, a first base seat part 122 (toward the X2 direction), and a second base seat part 123 (toward the X1 direction). Each of the first and second base seat parts 122, 123 is formed with a shallow recess part 124 at its an inner side for enabling a plate part 136 (described below) to be inserted therein. Furthermore, engagement step parts 125 are provided on the sides of the housing 120 for enabling engagement with respect to hook parts 137 (described below).

Figure 6:
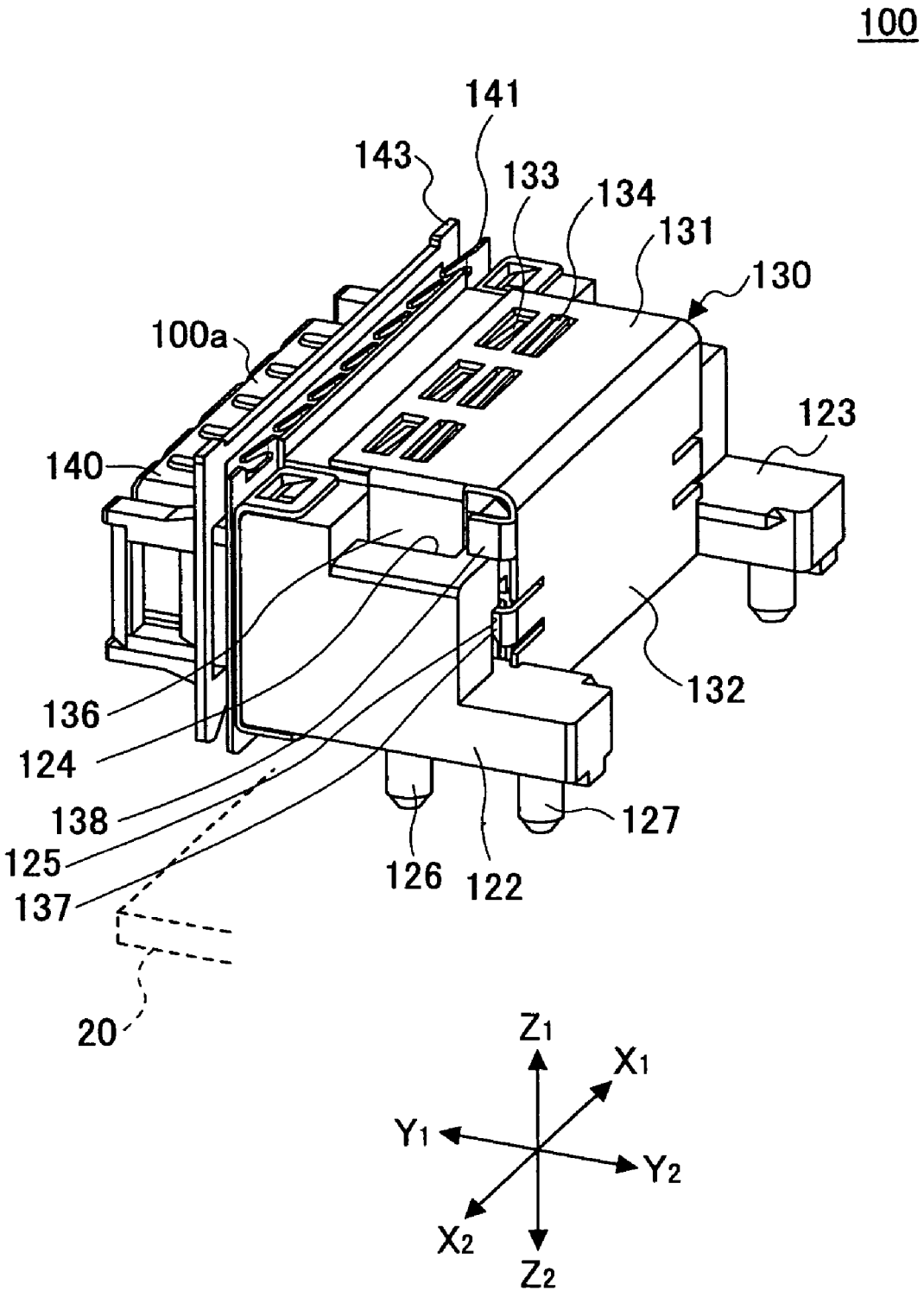
FIG. 6 is a perspective view of the connector shown in FIG. 3 in a state of having a shield cover member attached thereto.

As shown in FIGS. 4 and 6, reference numeral 140 indicates a front shield cover member, reference numeral 141 indicates a gasket member, and reference numeral 143 indicates a fastener member. The front shield cover member 140, the gasket member 141, and the fastener member 143 are formed from a metal plate.

With reference to FIGS. 3 and 4, the connector 100 is assembled by: inserting the connector block member 102 into the square-shaped frame part 121 of the housing 120 from the Y2 direction to the Y1 direction; engaging the front shield cover member 140 with the front part 104 of the connector block member 102 protruding in the Y1 direction from the housing 120, so that the front part 104 is covered by the front shield cover member 140; engaging the gasket member 141 with the front shield cover member 140; and fastening the gasket member 141 with the fastening member 143.

The completion of the assembly of the connector 100 allows the first and second base seat parts 122 and 123 of the housing 120 to be situated along the sides of the connector main body 101. As shown in FIG. 3, a connecting part(s) 100*a* is provided in the front side of the connector 100, and a contact alignment 100*b* (i.e., alignment of contact members) corresponding to a terminal pad of an end part of the printed board 20 is provided in the rear side 103 of the connector 100. The contact alignment 110*b* includes the elongated parts, or members, 111*b*, 112*b*, 115*b* and the mounting contact parts, or members, 111*c*, 112*c*, 115*c*.

With reference to FIGS. 6 and 7(A) and 7(B), the connector 100 is mounted to the end part of the printed board 20. In FIG. 7(B), the connector 100 is fixed to the printed board 20 by having leg parts 126 and 127 of the housing 120 inserted in the holes 21 of the printed board 20. This inserted portion is soldered, to thereby secure the fixed state. Furthermore, the mounting contact parts 112*c*, 111*c*, 115*c* on the rear part are soldered to the terminal pad of the end part of the printed board 20.

[Rear Shield Cover Member 130]

Figure 7:
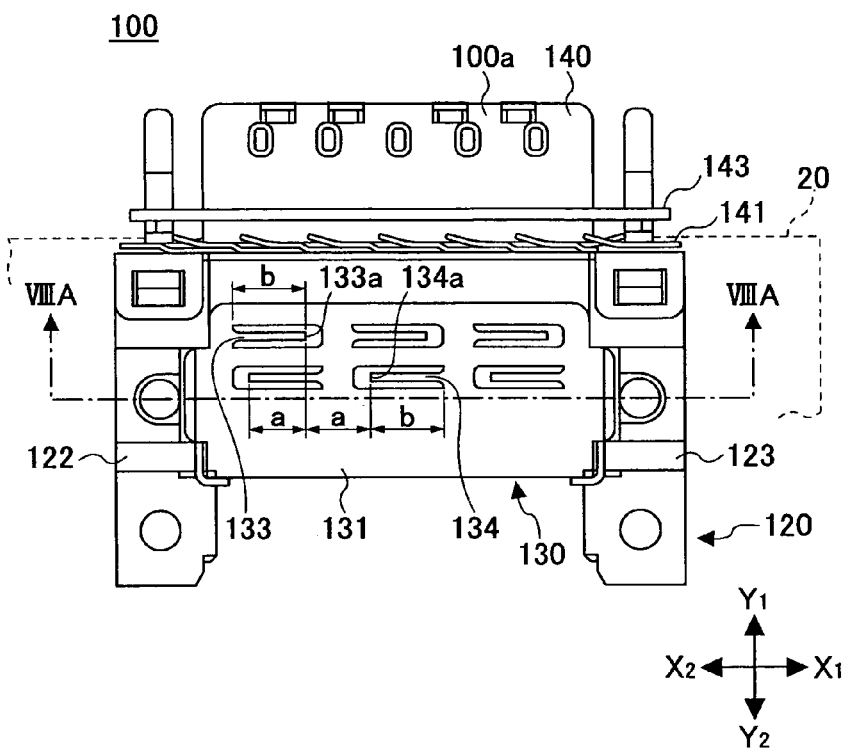
FIG. 7 is another view of the connector shown in FIG. 3 in a state of having a shield cover member attached thereto.
Figure 7:
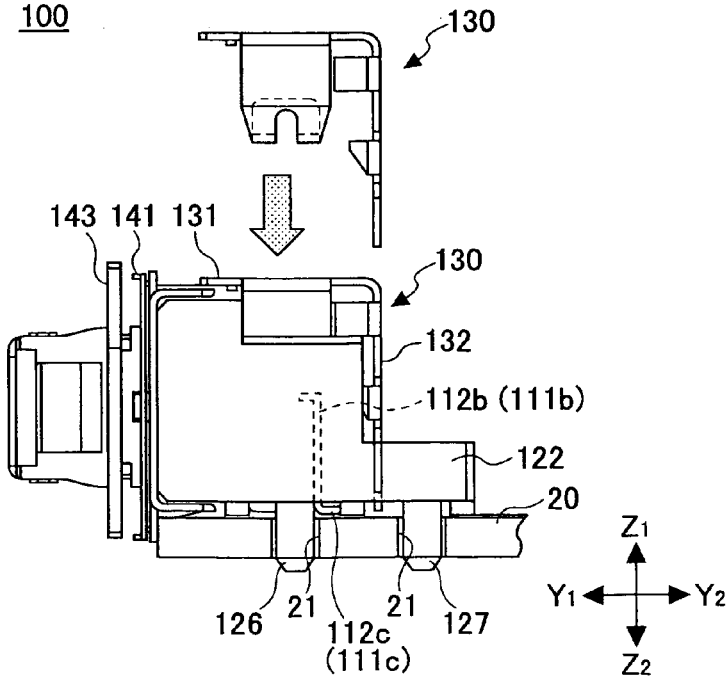

With reference to FIGS. 3 and 7, the rear shield cover member 130 is a component which is formed by press molding a metal plate. The rear shield cover member 130 has an L-shape when viewed from the X2 direction. The rear shield cover member 130 includes a top plate part 131 and a vertical rear plate part 132. Multiple cantilever shaped flat spring parts 133 and 134 are aligned in two rows at the top plate part 131. Each flat spring part 133, being aligned in the first row, includes a base part provided in the X2 direction and a contact part 133*a* provided in the X1 direction. Each flat spring part 134, being aligned in the second row, includes a base part provided in the X1 direction and a contact part 134*a* provided in the X2 direction. The contact parts 133*a* and the contact parts 134*a* are aligned in a staggered manner. In order to prevent emanation of electromagnetic noise, the distance "a" between the adjacently disposed (in direction X1-X2) contact parts 133*a*, 134*a* is to be less than a predetermined length. Particularly, as shown in FIG. 7(A), since the flat spring parts 133 of the first row and the flat spring parts 134 of the second row are faced opposite to each other, the distance "a" between the adjacent contact parts 133*a* and the contact parts 134*a* can be shortened and the length "b" of the flat spring parts 133 and the flat spring parts 134 can be extended to a length greater than that of a typical length. The flat spring parts 133 and 134 have a high spring property.

The top plate part 131 is provided with U-shaped lug parts 135 which are formed on its X2 direction side and its X1 direction side. The U-shaped lug parts 135 are formed by bending a plate part 136 extending from the top plate part 131 from the Z1 direction to the Z2 direction. The rear plate part 132 is provided with a hook part 137 (facing the Y1 direction) formed on its X2 direction side. The rear plate part 132 is provided with a square-shaped lug part 138. The hook part 137 is situated at a tip of a cantilever-like arm part that is formed by providing slits in the rear plate part 132.

[Attachment of Rear Shield Cover Member]

The rear shield cover member 130 is attached to the connector 100 mounted on the printed board 20. The rear shield cover member 130 is attached to the connector 100 in a manner covering the rear side of the connector 100. In attaching the rear shield cover member 130, the rear shield cover member 130 is lowered from the direction Z1 to the direction Z2 (See FIG. 3) for inserting with force the U-shaped lug part 135 into a space 145 formed between the base seat parts 122, 123 and the connector main body 101 (provided by the recess part 124). Thereby, the rear shield cover member 130 is attached to the connector 100 and fixed in place as shown in FIG. 6 and FIG. 7 ((A), (B)).

Figure 8:
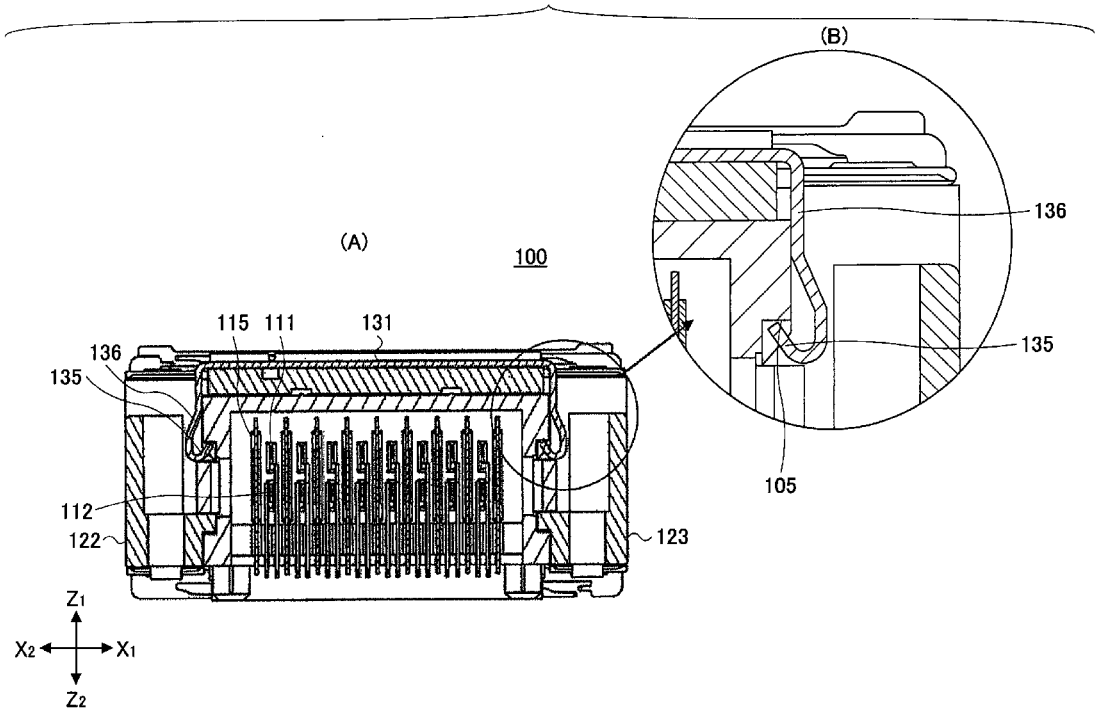
FIG. 8 is a schematic drawing of the connector shown in FIG. 3, in which (A) is a cross-sectional view of the connector shown in FIG. 3 along line VIIIA—VIIIA in FIG. 7, and (B) is an enlarged view of a portion shown in (A)

In FIG. 8, (A) is a cross-sectional diagram along line VIIIA—VIIIA of (A) of FIG. 7. As shown in FIGS. 3 and 8((A) and (B)), the U-shaped lug parts 135 are engaged with the engagement step parts 105 of the block member 102 and the hook parts 137 are engaged with the engagement step parts 125 of the housing 120, to thereby fix the rear shield cover member 130 to the connector 100 at four points for preventing detachment of the rear shield cover member 130 in the Z1 direction. Furthermore, the plate parts 136, which are provided on both sides of the rear shield cover member 130, are inserted into the shallow recess parts 124 for restricting movement of the rear shield cover member 130 in the Y1-Y2 directions.

In this attached state, the contact parts 133*a*, 134*b* of the flat spring parts 133, 134 abut an upper face of the top plate part 120*a* of the housing 120, to thereby flexibly bend the flat spring parts 133 and 134. The bending of the flat spring parts 133 and 134 causes the rear shield cover member 130 to be urged in the Z1 direction. Furthermore, the U-shaped lug parts 135 and the hook parts 137 abut and apply force to the corresponding engagement step parts 105, 125. Accordingly, the rear shield cover part 130 is in a state where there is no play in the Z1-Z2 direction.

Furthermore, the abutment between the contact parts 133*a*, 134*a* of the flat spring parts 133, 134 and the top plate part 120*a* of the frame part 121 of the housing 120 enables the rear shield cover member 130 to contact the housing 120 at multiple areas, thereby ensuring a frame ground potential and an electromagnetic shielding function.

[Electromagnetic Shielding Effect of Rear Shield Cover Member]

Next, the electromagnetic shielding effect of the rear shield cover member 130 is described.

As shown in (B) of FIG. 7, the rear plate part 132 covers the elongated parts 111*b*, 112*b*, 115*b* as well as the mounting contact parts 111*c*, 112*c*, 115*c* soldered to the terminal pad of the printed board 20. Furthermore, the plate parts 136 and the lug parts 138 of the rear shield cover part 130 cover the space between the top plate part 131 and the housing 120 in the X1-X2 direction. Accordingly, the rear shield cover member 130 can block the electromagnetic noise created at the elongated parts 111*b*, 112*b* and the mounting contact parts 111*c*, 112*c*. Thus, other electronic components inside the electronic device can be prevented from being adversely affected by the electromagnetic noise. Furthermore, electromagnetic noise generated by other electronic components inside the electronic device can be prevented from reaching the elongated parts 111*b*, 112*b* and the mounting contact parts 111*c*, 112*c*.

Second Embodiment

Figure 9:
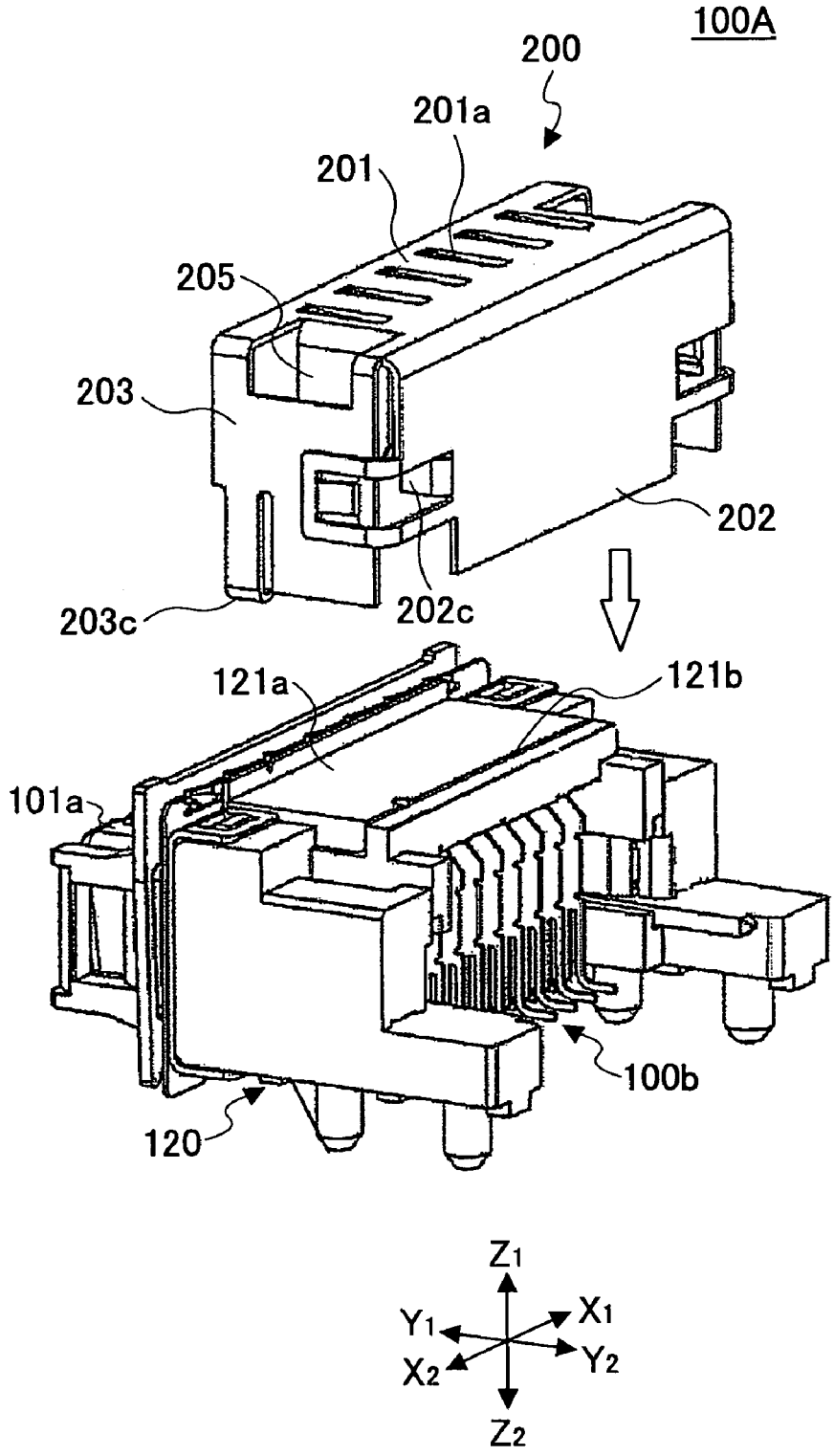
FIG. 9 is a perspective view showing a right angle type connector used for balanced transmission according to a second embodiment of the present invention.

FIG. 9 shows a connector 100A according to a second embodiment of the present invention, in which the connector 100A is also a right angle type connector used for transmitting data by balanced transmission (differential transmission). The connector 100A includes a connector main body 101*a*, a housing 120, and a rear shield cover member 200. The rear shield cover member 200 of the connector 100A is different from the rear shield cover member 130 of the connector 100 shown in FIG. 3. It is to be noted that like components are denoted by like reference numerals as of the first embodiment of the present invention and are not further described.

Figure 10:
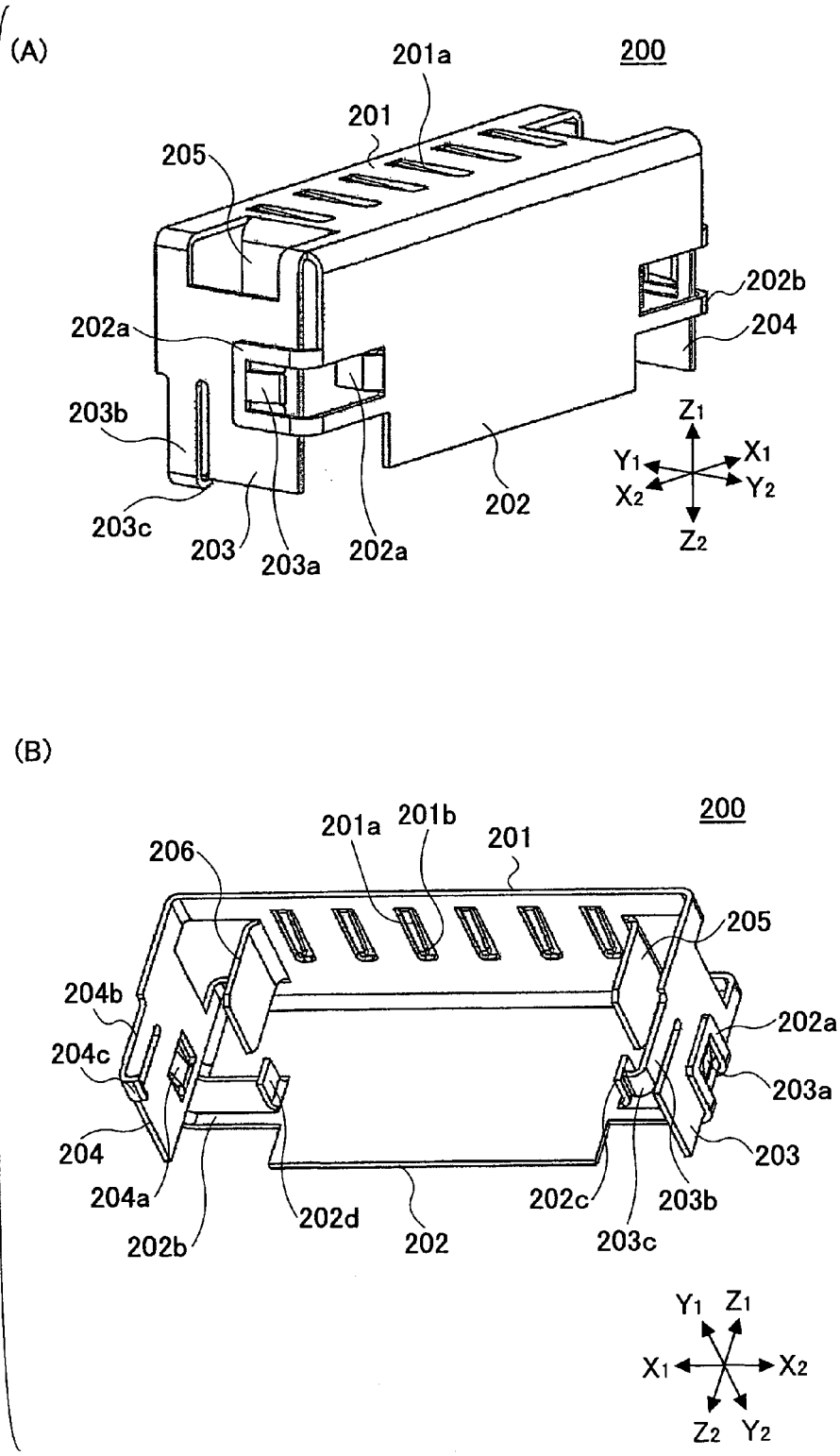
FIG. 10 is a perspective view showing a shield cover member of the connector shown in FIG. 9.

As shown in (A) and (B) of FIG. 10, the rear shield cover member 200 is shaped as a box. The rear shield cover member 200 includes a top plate part 201, a rear plate part 202, side plate parts 203, 204, and inner side plates 205, 206. Multiple flat spring parts 201*a* are provided in the top plate part 201 by cutting corresponding parts of the rear shield cover member 200 in a manner projecting toward the inner side of the rear shield cover member 200. The flat spring parts 201*a* are aligned in direction X1-X2. One end (toward direction Y2) of each of the flat spring members 201*a* is a contact part 201*b*. U-shaped arm parts 202*a* and 202*b* are provided extending from the rear plate part 202 in directions X1, X2 and are bent perpendicularly, to thereby engage with cut-projecting parts 203*a* and 204*a* of side plate part 203 and 204. Furthermore, the side plate parts 203 and 204 (toward direction Y1) are provided with arm parts 203*b* and 204*b* which are elongated in the Z1-Z2 direction. The ends (toward direction Z2) of the arm parts 203*b* and 204*b* are provided with hook parts 203*c* and 204*c*, respectively, which are bent toward the inner side of the rear shield cover member 200. Furthermore, U-shaped lug parts 202*c* and 202*d*, which are bent in direction Y1, are provided in the area of the base part of the U-shaped arm parts 202*a* and 202*b*, respectively. When viewed from direction X1-X2, the inner side plate 205 and the lug part 202*c* are situated on a same plane, and the inner side plate 206 and the lug part 202*d* are situated on a same plane.

Figure 11:
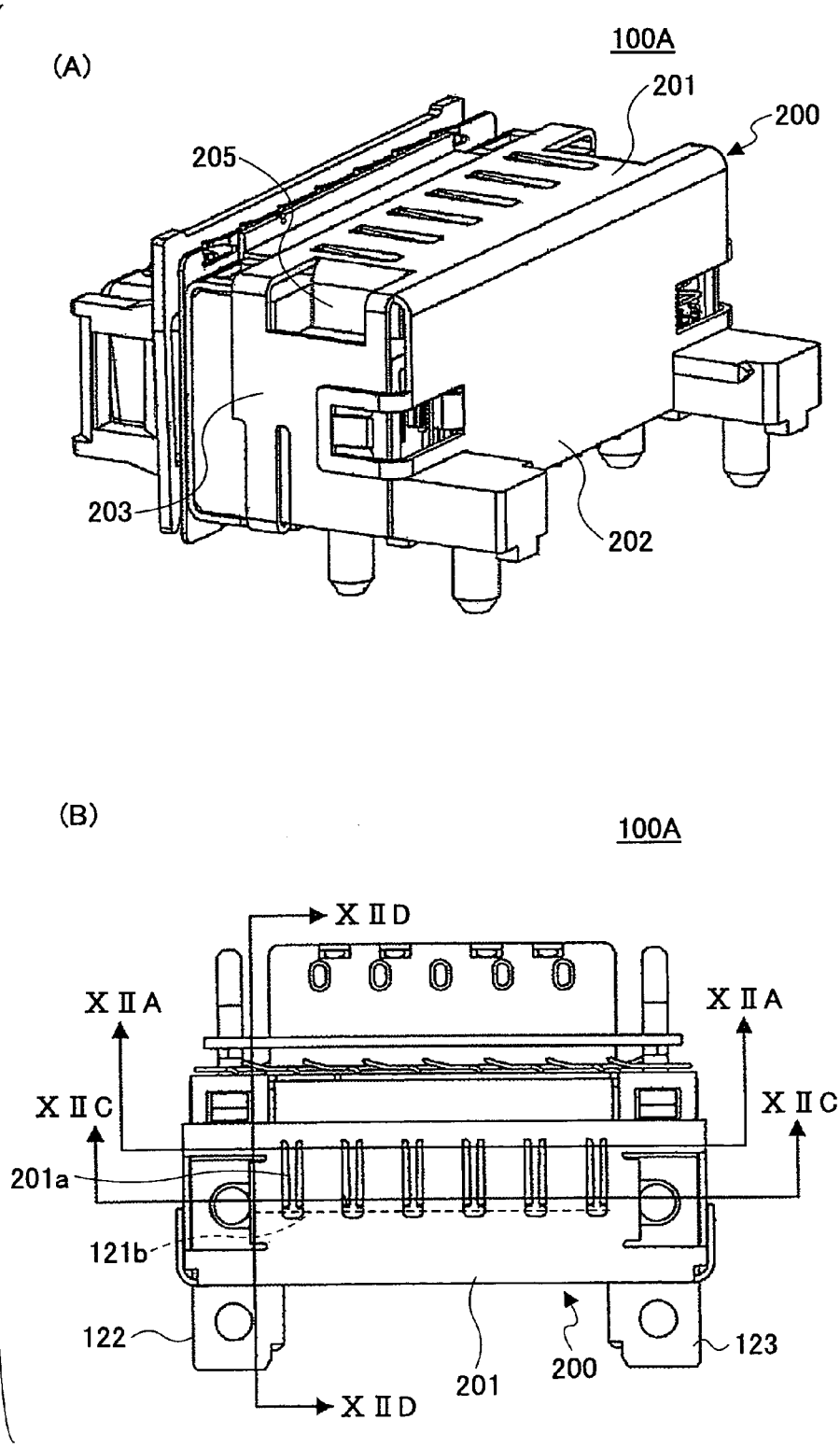
FIG. 11 is a schematic view of the connector shown in FIG. 9 in a state of having a shield cover member attached thereto.

In a state where the connector 100A is mounted on the printed board 20, the rear shield cover member 200 is attached to the connector 100A from direction Z1 to direction Z2 (vertical direction) as shown in FIG. 9, to thereby cover the rear side of the connector 100A (See (A) and (B) of FIG. 11).

Figure 12:
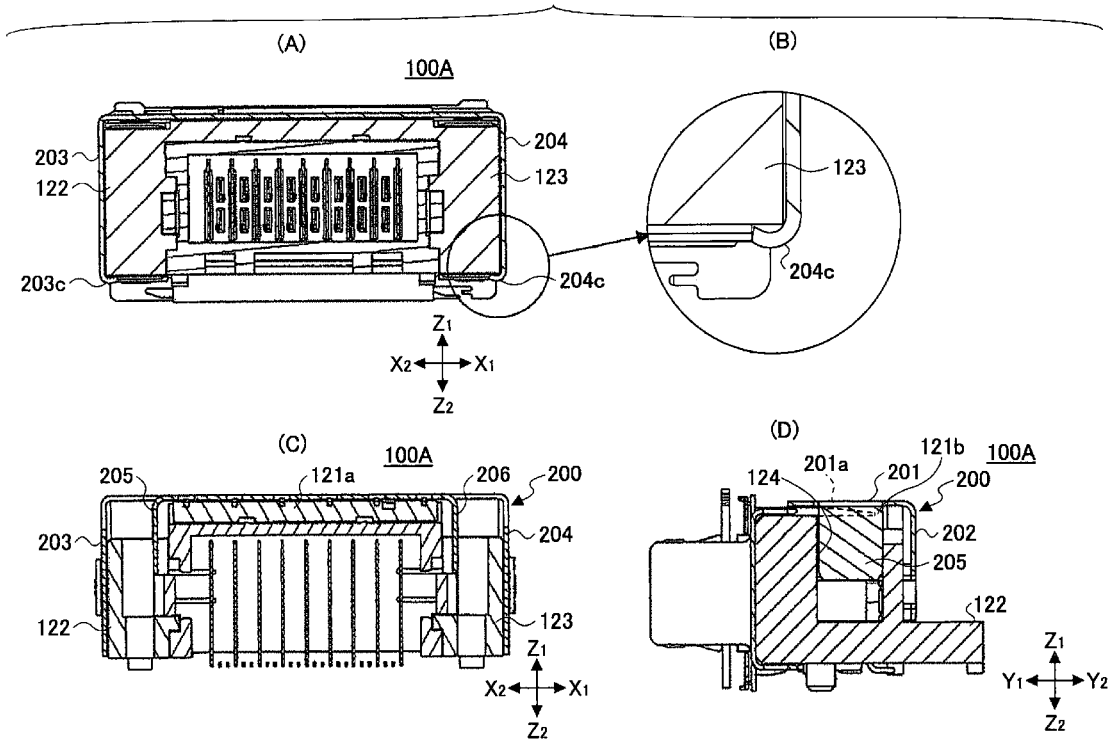
FIG. 12 is a schematic drawing of the connector shown in FIG. 9, in which (A) is a cross-sectional view of the connector shown in FIG. 9 along line XIIA—XIIA in FIG. 11, (B) is an enlarged view of a portion shown in (A), (C) is a cross-sectional view of the connector shown in FIG. 9 along line XIIC—XIIC in FIG. 11, and (D) is an enlarged view of a portion shown in (C)

In FIG. 12, (A) is a cross-sectional view along line XIIA—XIIA of (B) of FIG. 11, (C) is a cross-sectional view along line XIIC—XIIC of (B) of FIG. 11, and (D) is a cross-sectional view along line XIID—XIID of (B) of FIG. 11. The rear shield cover member 200 is attached in a manner shown in FIG. 12. When the rear shield cover member 200 is pressed against the connector 100A towards direction Z1, the arm parts 203*b*, 204*b* are bent in a manner that their hook parts 203*c*, 204*c* are bent outward. Then, when the rear shield cover member 200 is set in its final position, the hook parts 203*c*, 204*c* engage the bottom face of the housing 120, as shown in (A) and (B) of FIG. 12. Thereby, the rear shield cover member 200 can be prevented from detaching in the Z1 direction.

The contact parts 201*b* of the flat spring parts press against the top face of the housing 120 and engage the step parts 121*b* (toward direction Y2) of the top plate part 121*a* of the housing 120. This prevents detachment of the rear shield cover member 200 in direction Y2.

The inner side plates 205, 206 are engaged with the housing 120 at the recess parts 124 provided in the inner side of the first and second base seat parts 122, 123 of housing 120. This restricts movement of the rear shield cover member 200 in the direction Y1-Y2.

The attachment of the rear shield cover member 200 enables the rear shield cover member 200 to contact the housing 120 at multiple areas, thereby covering the alignment of the contact parts 100*b* while maintaining a frame ground potential. Accordingly, electromagnetic noise can be prevented from penetrating into the electronic device. According to the connector 100A of the second embodiment of the present invention, the connector 100A is able to provide a greater electromagnetic shielding effect than the connector 100 of the first embodiment of the present invention since the rear shield cover member 200 is shaped as a box.

Third Embodiment

Figure 13:
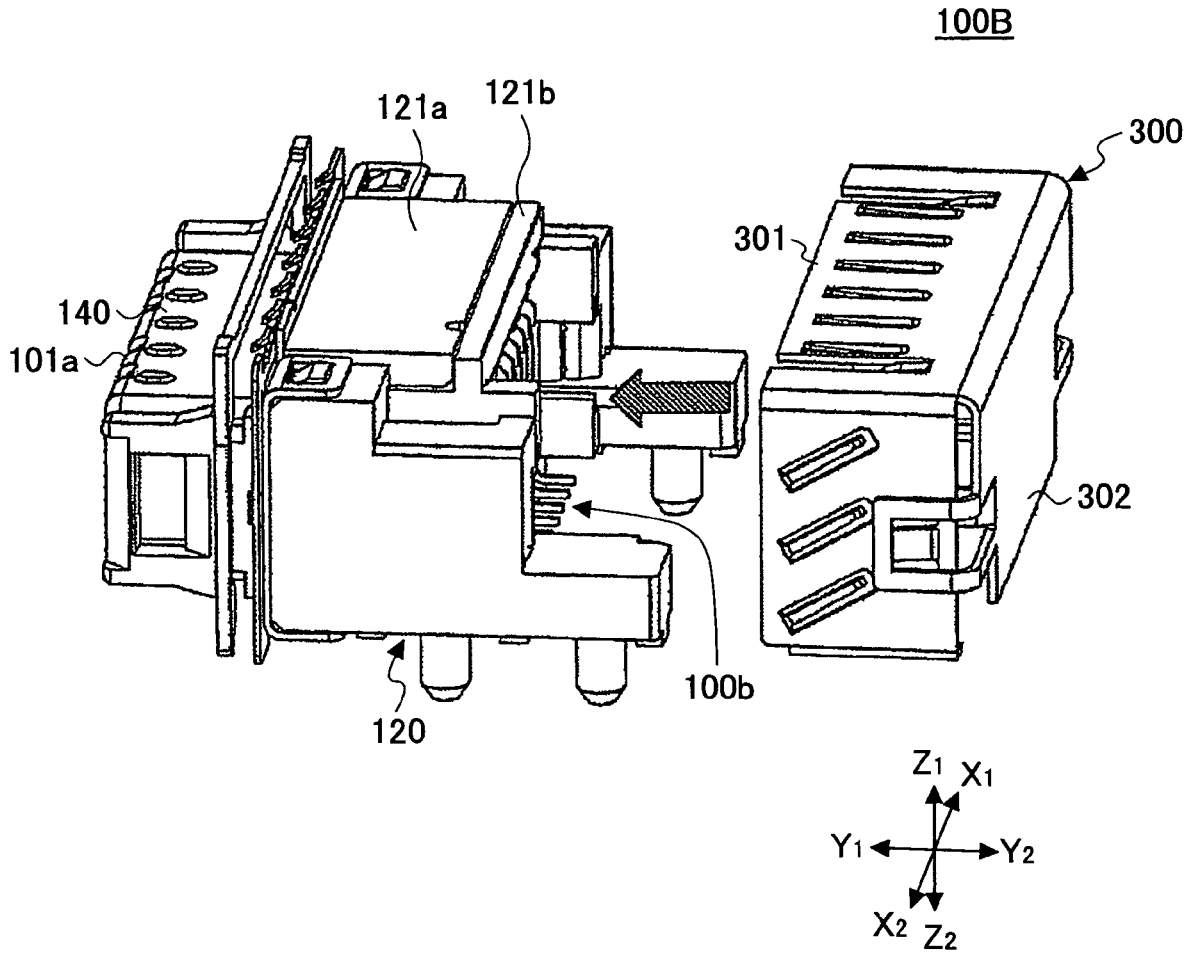
FIG. 13 is a perspective view showing a right angle type connector used for balanced transmission according to a third embodiment of the present invention.

FIG. 13 shows a connector 100B according to a third embodiment of the present invention, in which the connector 100B is also a right angle type connector used for transmitting data by balanced transmission (differential transmission). The connector 100B includes a connector main body 101*a*, a housing 120, and a rear shield cover member 300. The rear shield cover member 300 of the connector 100B is different from the rear shield cover member 130 of the connector 100 shown in FIG. 3. In comparing the connector 100B with the connector 100A shown in FIG. 9, the rear shield cover member 300 is configured to enable attachment to the connector 100B from direction Y2 to direction Y1 (horizontal direction). It is to be noted that like components are denoted by like reference numerals as of the first and second embodiments of the present invention and are not further described.

Figure 14:
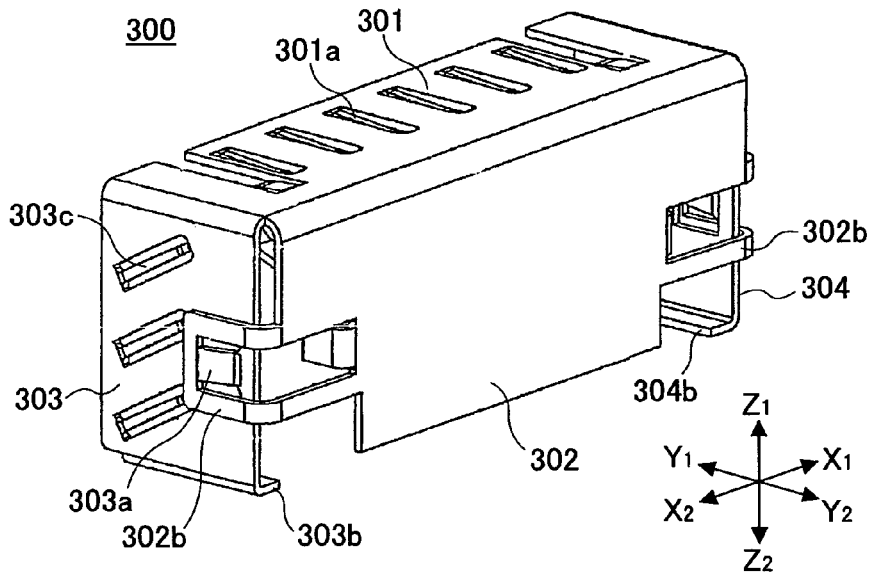
FIG. 14 is a perspective view showing a shield cover member of the connector shown in FIG. 13.
Figure 14:
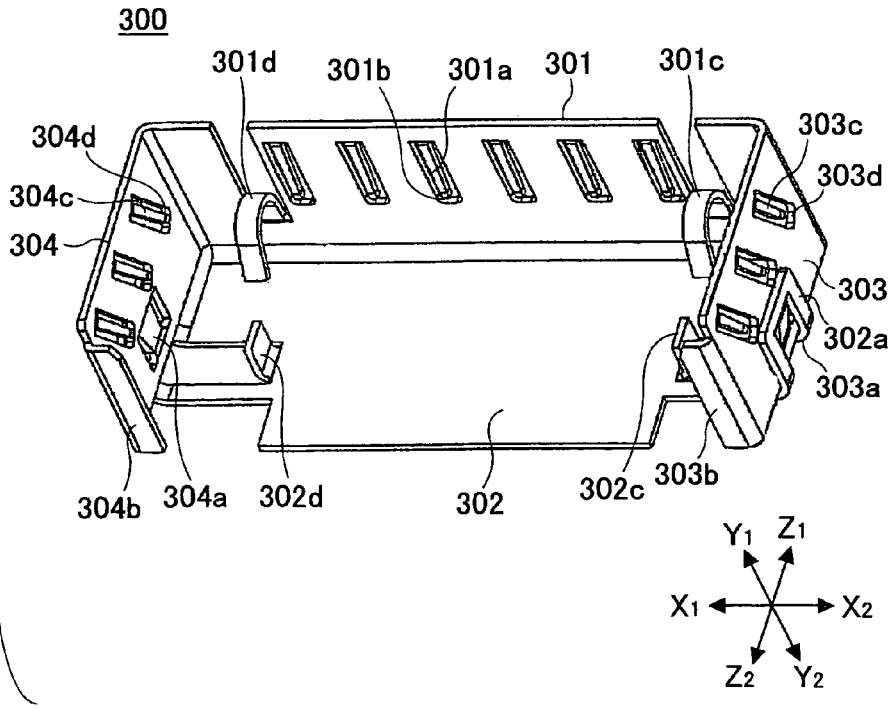

As shown in (A) and (B) of FIG. 14, the rear shield cover member 300 is shaped as a box. The rear shield cover member 300 includes a top plate part 301, and a rear plate part 302, and side plate parts 303, 304. Multiple flat spring parts 301*a* are provided on the top plate part 301 by cutting corresponding parts of the rear shield cover member 300 in a manner projecting toward the inner side of the rear shield cover member 300. The flat spring parts 301*a* are aligned in direction X1-X2. One end (toward direction Y2) of the flat spring member 301*a* is a contact part 301*b*. Furthermore, U-shaped flat spring parts 301*c*, 301*d* are provided on the top plate part 301 by cutting corresponding parts of the rear shield cover member 300 in a manner projecting toward the inner side of the rear shield cover member 300 and thus bent into a U-shape from the Y1 direction. U-shaped arm parts 302*a* and 302*b* are provided extending from the rear plate part 302 in directions X1, X2 and are bent perpendicularly, to thereby engage with cut-projecting parts 303*a* and 304*a* of side plate part 303 and 304. The ends (toward direction Z2) of the side plate parts 303, 304, respectively, are provided with hook parts 303*b* and 304*b* which are bent toward the inner side of the rear shield cover member 200. Multiple flat spring parts 303*c*, 304*c* are provided on the side plate parts 303, 304 by cutting corresponding parts of the rear shield cover member 300 in a manner projecting toward the inner side of the rear shield cover member 300. The flat spring parts 303*c*, 304*c* are arranged in an inclined manner. One end (toward direction Y2) of the flat spring member 303*c*, 304*c* is a contact part 303*d*, 304*d*, respectively. Furthermore, in the flat spring parts 303*c*, 303*d*, lug parts 302*c* and 302*d*, which are bent in direction Y1, are provided in the area of the base part of the U-shaped arm parts 302*a* and 302*b*.

Figure 15:
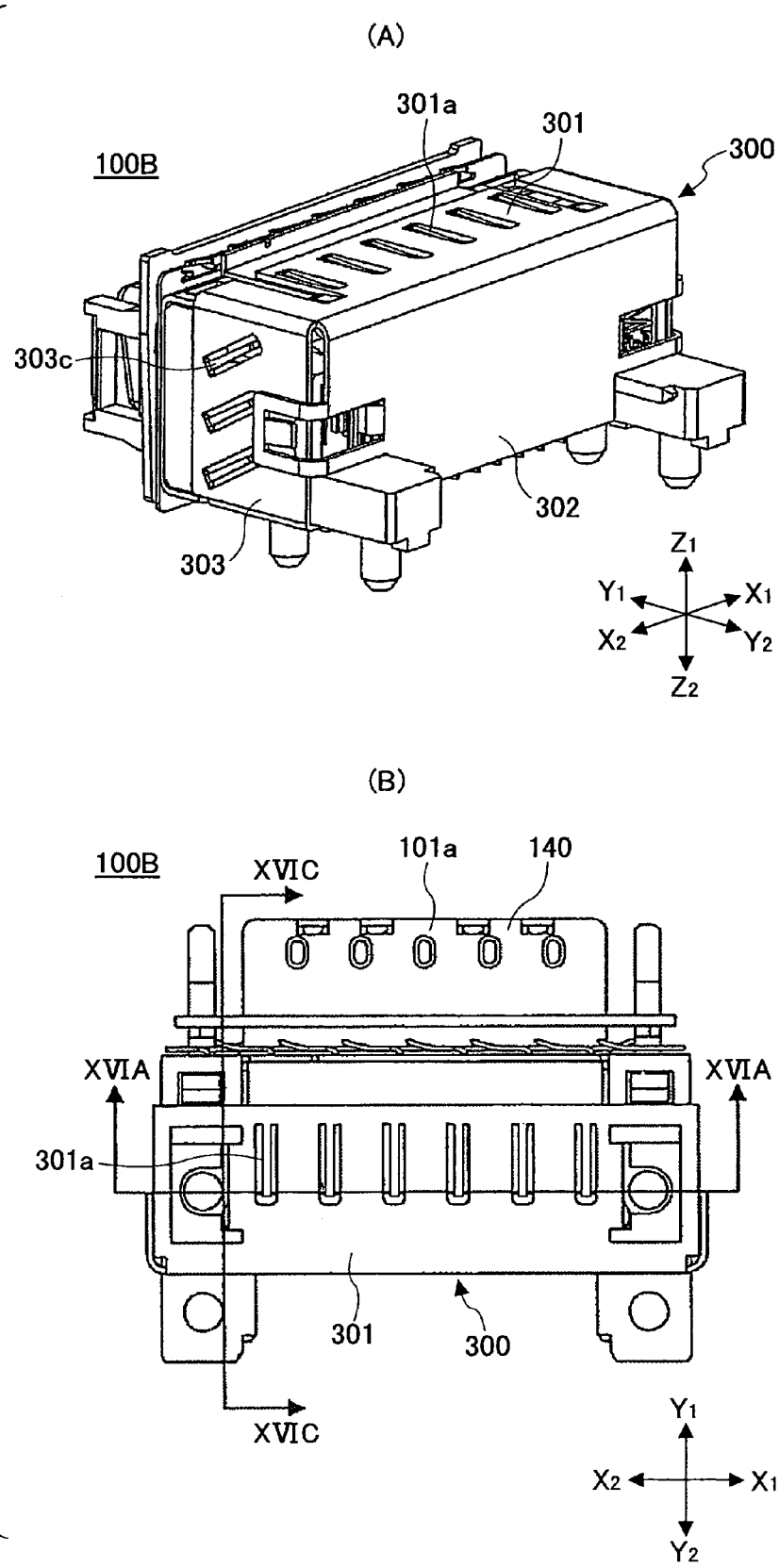
FIG. 15 is a schematic view of the connector shown in FIG. 13 in a state having a shield cover member attached thereto.

In a state where the connector 100B is mounted on the printed board 20, the rear shield cover member 300 is attached to the connector 100B from direction Y2 to direction Y1 (horizontal direction) as shown in FIG. 13, to thereby cover the rear side of the connector 100B (See (A) and (B) of FIG. 15).

Figure 16:
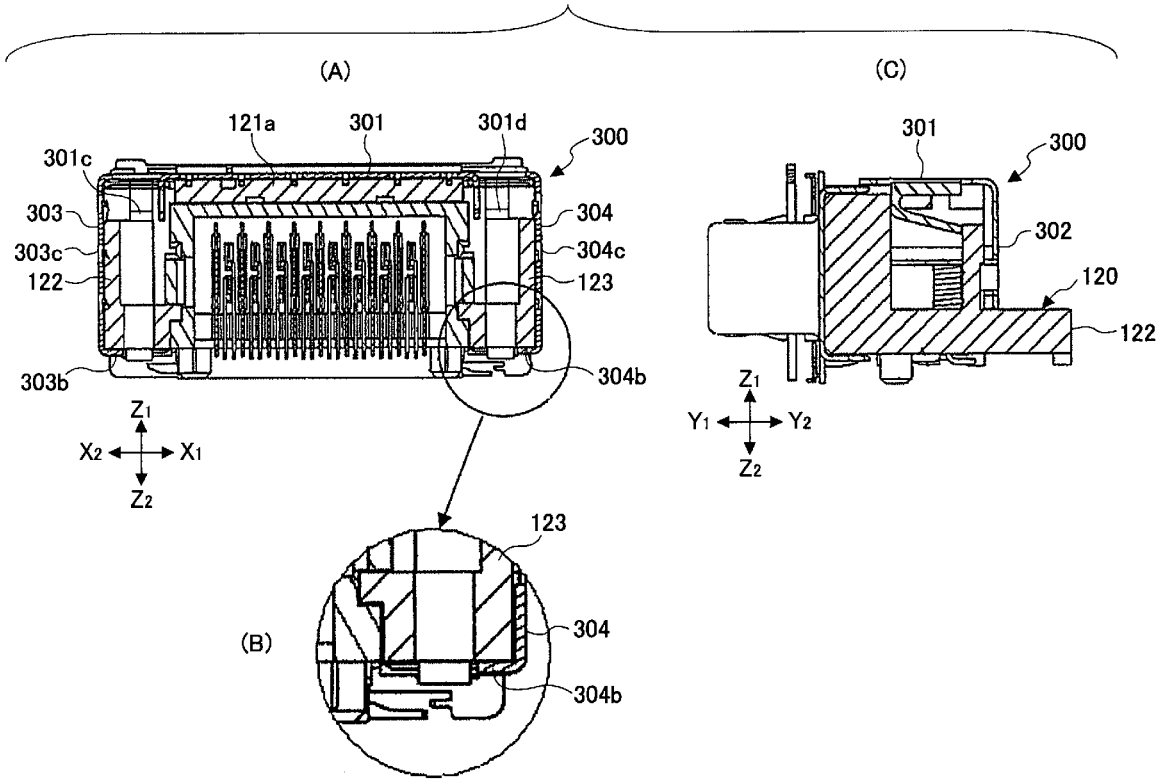
FIG. 16 is a schematic drawing of the connector shown in FIG. 13, in which (A) is a cross-sectional view of the connector shown in FIG. 13 along line XVIC—XVIC in FIG. 15 and (B) is an enlarged view of a portion shown in (A).

In FIG. 16, (A) is a cross-sectional view along line XVIA—XVIA of (B) of FIG. 15, and (C) is a cross-sectional view along line XVIC—XVIC of (B) of FIG. 15. The rear shield cover member 300 is attached in a manner shown in (A)–(C) of FIG. 16. When the rear shield cover member 300 is pressed against the connector 100B from direction Y2 to direction Y1, the hook parts 303*b*, 304*b* engage the bottom face of the first and second base seat parts 122, 123 of the housing 120, the U-shaped flat spring parts 301*c*, 301*d* slide on the upper face of the first and second base seat parts 122, 123, the flat spring parts 301*a* slide on the upper face of the housing 120, and the flat spring parts 303*c*, 304*c* slide on the side face of the first and second base seat parts 122, 123.

When the rear shield cover member 300 is set in its final position, the contact parts 301*b* of the flat spring parts 301*a* engage the step part of the upper face of the housing 120. Thereby, the rear shield cover member 300 can be prevented from detaching in the Y2 direction. The lug parts 302*c*, 302*d* engage the housing 120 at the recess parts 124 provided in the inner side of the first and second base seat parts 122, 123 of the housing 120. This restricts movement of the rear shield cover member 300 in the Z1 direction.

The attachment of the rear shield cover member 300 enables the rear shield cover member 300 to contact the housing 120 at multiple areas, thereby covering the alignment of the contact parts 100*b* while maintaining a frame ground potential. Accordingly, electromagnetic noise can be prevented from penetrating (leaking) into the electronic device. According to the connector 100B of the third embodiment of the present invention, the connector 100B is able to provide a greater electromagnetic shielding effect than the connector 100 since the rear shield cover member 300 is shaped as a box.

Further, the present invention is not limited to these embodiments, but various variations and modifications may be made without departing from the scope of the present invention.

What is claimed is:

1. A right-angle type connector used for balanced transmission of data, the connector comprising:

a connector main body, the connector main body including an alignment of contact members including a first signal contact member, a second signal contact member, and a ground contact member;

a housing including respective base seat parts with a conductive surface and including respective base seat parts including respective base seat parts on spaced, opposite sides of the housing, the base seat parts having the connector main body affixed therebetween and the alignment of contact members being partly exposed at a rear side of the connector main body;

a rear shield cover member mounted on the housing and covering at least the exposed part of the alignment of contact members, the rear shield cover member being mounted on the housing via a plurality of springs on at least a top plate part of the rear shield cover member;

each of the springs including a contact part for ensuring a ground a potential contact with the conductive surface of the housing; and the first signal contact member, the second signal contact member, and the ground contact member being aligned in parallel facing the same direction.

2. The right-angle type connector as claimed in claim 1, wherein the exposed part of the alignment of contact members includes respective elongated parts extending in a vertical direction from the first signal contact member, the second signal contact member, and the ground contact member and a mounting contact part that extends in a horizontal direction from the elongated part.

3. The right-angle type connector as claimed in claim 1, wherein the rear shield cover member further comprises a rear plate part wherein the top plate part and the rear plate part are in an L-letter shape.

4. The right-angle type connector as claimed in claim 1, wherein the rear shield cover member includes a top plate part provided on a top part of the rear shield cover, a rear plate part provided on a rear part of the rear shield cover, and side plate parts provided on side parts of the rear shield cover, wherein the top plate part, the rear plate part, and the side plate parts are in a box shape.

5. The right-angle type connector as claimed in claim 1, wherein:

the housing further comprises a pair of first and second recesses respectively in the first and second base parts and a top plate extending between the first and second base seat parts; and the rear shield cover member further comprises a rear plate part integral with the top plate part, the top plate part further having integral locking plate parts with lugs on terminal ends thereof, depending from opposite edges of the top plate and spaced to be received and resiliently engaged in respective first and second recesses in the first and second base seat parts of the housing, in the assembled relationship of the housing and the rear shield cover member.

6. The right-angle type connector as claimed in claim 5, further comprising:

at least one pair of first and second hooks integral with and extending perpendicularly to the rear plate part and resiliently engaging a pair of corresponding first and second engagement step parts in interior side walls of the respective first and second basis seat parts, resiliently affixing the rear shield cover member to the housing.

7. The right-angle type connector as claimed in claim 1, wherein the housing is made of a conducting material providing shielding for the contact members.

8. The right-angle type connector as claimed in claim 7, wherein the contact parts of the springs engage the top plate of the housing and complete an electrical ground potential connection therethrough.

9. The right-angle type connector as claimed in claim 5, wherein the lugs of the blocking plate parts engage the slots on outside surface edges of the top plate and complete an electrical ground potential connection thereto.

10. The right-angle type connector as claimed in claim 6, wherein the first and second hooks engage the pair of corresponding first and second engagement step parts and complete an electrical ground potential connection therethrough.

11. The right-angle type connector as claimed in claim 1, wherein the shield cover member includes a plurality of flat spring members abutting the housing.

12. The right-angle type connector as claimed in claim 11, wherein the plural spring members are aligned in plural rows, wherein the flat spring members in one row of the plural rows face in an opposite direction with respect to the flat spring members of another row.

13. The right-angle type connector as claimed in claim 1, wherein the shield cover member includes hook parts that are flexibly engaged with the base seat parts on both sides of the housing.

14. A right-angle type connector used for balanced transmission of data, the connector comprising:

a connector main body, the connector main body including an alignment of contact members including a first signal contact member, a second signal contact member, and a ground contact member;

a housing including respective base seat parts with a conductive surface and including respective base seat parts including respective base seat parts on spaced, opposite sides of the housing, the base seat parts having the connector main body affixed therebetween and the alignment of contact members being partly exposed at a rear side of the connector main body;

a rear shield cover member mounted on the housing and covering at least the exposed part of the alignment of contact members, the rear shield cover member being mounted on the housing via a plurality of springs on at least a top plate part of the rear shield cover member;

each of the springs including a contact part for ensuring a ground a potential contact with the conductive surface of the housing; and the first signal contact member, the second signal contact member, and the ground contact member being aligned in parallel facing the same direction;

wherein the housing further comprises a pair of first and second recesses respectively in the first and second base parts and a top plate extending between the first and second base seat parts; and the rear shield cover member further comprises a rear plate part integral with the top plate part, the top plate part further having integral locking plate parts with lugs on terminal ends thereof, depending from opposite edges of the top plate and spaced to be received and resiliently engaged in respective first and second recesses in the first and second base seat parts of the housing, in the assembled relationship of the housing and the rear shield cover member.

15. The right-angle type connector as claimed in claim 14, further comprising:

at least one pair of first and second hooks integral with and extending perpendicularly to the rear plate part and resiliently engaging a pair of corresponding first and second engagement step parts in interior side walls of the respective first and second basis seat parts, resiliently affixing the rear shield cover member to the housing.

16. The right-angle type connector as claimed in claim 14, wherein the lugs of the blocking plate parts engage the slots on outside surface edges of the top plate and complete an electrical ground potential connection thereto.

17. The right-angle type connector as claimed in claim 15, wherein the first and second hooks engage the pair of corresponding first and second engagement step parts and complete an electrical ground potential connection therethrough.

* * * * *

UNITED STATES PATENT AND TRADEMARK OFFICE

CERTIFICATE OF CORRECTION

PATENT NO. : 7,168,987 B1
APPLICATION NO. : 11/178394
DATED : January 30, 2007
INVENTOR(S) : Haruna Morohoshi et al.

It is certified that error appears in the above-identified patent and that said Letters Patent is hereby corrected as shown below:

Col. 10, lines 1 and 3, delete "including respective base seat parts"

Col. 10, line 14, delete "a" second occurrence

Col. 11, lines 28 and 30, delete "including respective base seat parts"

Signed and Sealed this

Tenth Day of April, 2007

JON W. DUDAS
*Director of the United States Patent and Trademark Office*